US012037930B2

(12) United States Patent
Borla

(10) Patent No.: US 12,037,930 B2
(45) **Date of Patent: *Jul. 16, 2024**

(54) TIMBRE SCALED EXHAUST SYSTEM

(71) Applicant: David Akiba Borla, Thousand Oaks, CA (US)

(72) Inventor: David Akiba Borla, Thousand Oaks, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/325,160

(22) Filed: May 30, 2023

(65) Prior Publication Data

US 2023/0383677 A1 Nov. 30, 2023

Related U.S. Application Data

(63) Continuation of application No. 17/021,018, filed on Sep. 15, 2020, now Pat. No. 11,661,870, which is a (Continued)

(51) Int. Cl.
*F01N 1/06* (2006.01)
*F01N 1/02* (2006.01)
*F01N 13/10* (2010.01)

(52) U.S. Cl.
CPC ..... *F01N 1/02* (2013.01); *F01N 2470/20* (2013.01)

(58) Field of Classification Search
CPC ... F01N 1/02; F01N 1/06; F01N 13/10; F01N 13/107; F01N 2470/14; F01N 2470/20
See application file for complete search history.

(56) References Cited

U.S. PATENT DOCUMENTS 734,868 A 7/1903 Hill
1,351,122 A 8/1920 Hans
(Continued)

FOREIGN PATENT DOCUMENTS

DE 4040721 7/1991
EP 0421724 4/1991
(Continued)

OTHER PUBLICATIONS

International Search Report dated Nov. 15, 2017 in PCT Patent Application No. PCT/US2017/043628.
(Continued)

*Primary Examiner* — Edgardo San Martin
(74) *Attorney, Agent, or Firm* — Robinson IP Law, PLLC

(57) ABSTRACT

A timbre-scaled exhaust assembly includes: an acoustic portion including an inlet collector including an entrance duct at a first end of the collector in fluid for receiving an exhaust flow from an internal combustion engine and exit ducts at a second end of the collector in fluid communication with a plurality of non-perforated tuning tubes; an outlet collector including entrance ducts in fluid communication with the plurality of non-perforated tuning tubes and an exit duct in fluid communication with an outlet of the exhaust assembly. The inlet collector splits the exhaust flow from the internal combustion engine into the plurality of tuning tubes such that a plurality of distinct exhaust flows pass through the plurality of tuning tubes and the outlet collector combines the exhaust flow. A combined exhaust flow exits the exhaust system through the exhaust tip.

20 Claims, 6 Drawing Sheets

Related U.S. Application Data continuation of application No. 15/658,750, filed on Jul. 25, 2017, now Pat. No. 10,808,584.

(60) Provisional application No. 62/366,167, filed on Jul. 25, 2016.

(56) References Cited

U.S. PATENT DOCUMENTS

| | | | | |
|---|---|---|---|---|
| 1,591,088 | A | 7/1926 | Holmes | |
| 1,740,805 | A | 12/1929 | Henry | |
| 1,903,803 | A | 4/1933 | Barker | |
| 2,019,697 | A | 11/1935 | Bernard | |
| 2,075,316 | A | 3/1937 | Eugen | |
| 2,896,739 | A | 7/1959 | Kuras | |
| 2,995,200 | A | 8/1961 | Vernon | |
| 2,996,139 | A | 8/1961 | Patterson | |
| 3,139,153 | A | 6/1964 | De Remer | |
| 3,447,630 | A | 6/1969 | Davidson | |
| 3,470,690 | A | 10/1969 | Thompson | |
| 3,491,534 | A * | 1/1970 | Garner | F01N 13/1805 60/323 |
| 3,507,301 | A | 4/1970 | Larson | |
| 3,572,463 | A | 3/1971 | Eschenburg | |
| 3,612,212 | A | 10/1971 | Macdonald | |
| 3,630,311 | A | 12/1971 | Nagamatsu | |
| 3,670,844 | A * | 6/1972 | Penfold, Jr. | F16L 55/033 181/240 |
| 3,948,349 | A | 4/1976 | Bychinsky | |
| 4,036,452 | A | 7/1977 | Schairer | |
| 4,064,962 | A | 12/1977 | Hunt | |
| 4,605,092 | A | 8/1986 | Harris | |
| 4,712,644 | A | 12/1987 | Yichang | |
| 4,800,719 | A | 1/1989 | Campbell | |
| 5,033,581 | A | 7/1991 | Feuling | |
| 5,198,625 | A | 3/1993 | Borla | |
| 5,199,258 | A * | 4/1993 | Barth | F01N 13/08 60/323 |
| 5,216,883 | A | 6/1993 | Flugger | |
| 5,816,044 | A * | 10/1998 | Biggs | F01N 13/10 60/323 |
| 6,038,855 | A * | 3/2000 | Markstrom | F01N 13/10 60/323 |
| 6,205,778 | B1 * | 3/2001 | Akaba | F01N 13/08 285/125.1 |
| 6,273,772 | B1 | 8/2001 | Smullin | |
| 6,478,340 | B1 | 11/2002 | Butler | |
| 6,634,171 | B1 * | 10/2003 | Banks, III | F01N 13/10 60/323 |
| 6,889,499 | B2 | 5/2005 | Bassani | |
| 7,380,635 | B2 | 6/2008 | Harris | |
| 7,731,241 | B2 * | 6/2010 | Aoki | F01N 13/1805 285/125.1 |
| 8,042,649 | B2 | 10/2011 | Inoue | |
| 8,196,703 | B2 | 6/2012 | Stanley | |
| 8,439,159 | B1 | 5/2013 | Borla | |
| 8,468,812 | B1 | 6/2013 | Banks, III | |
| 8,474,252 | B2 * | 7/2013 | Butler | F01N 13/10 60/322 |
| 9,638,087 | B2 | 5/2017 | Kim | |
| D852,697 | S * | 7/2019 | Borla | D12/194 |
| 10,808,584 | B2 | 10/2020 | Borla | |
| 11,661,870 | B2 * | 5/2023 | Borla | F01N 1/02 181/228 |
| 2007/0095056 | A1 | 5/2007 | Richter | |
| 2017/0362991 | A1 | 12/2017 | Schneider et al. | |
| 2018/0094757 | A1 | 4/2018 | Niaz | |

FOREIGN PATENT DOCUMENTS

| | | |
|---|---|---|
| GB | 442186 | 2/1936 |
| JP | 2006250022 | 9/2006 |
| WO | 2012048314 | 4/2012 |

OTHER PUBLICATIONS

International Preliminary Report on Patentability mailed on Jan. 29, 2019, in International Application No. PCT/US2017/043628.

* cited by examiner

TIMBRE SCALED EXHAUST SYSTEM

CROSS-REFERENCE TO RELATED APPLICATION

This application claims priority to and is a continuation of U.S. application Ser. No. 17/021,018 for a Timbre Scaled Exhaust System filed on Sep. 15, 2020, which claims priority to and is a continuation of U.S. application Ser. No. 15/658,750 for a Timbre Scaled Exhaust System filed on Jul. 25, 2017, which claims priority to and is a non-provisional of U.S. provisional patent application Ser. No. 62/366,167 filed on Jul. 25, 2016 for a Timbre Scaled Exhaust System, the contents of which are incorporated herein by reference in its entirety.

FIELD

This disclosure relates to the field of exhaust components for vehicles. More particularly, this disclosure relates to an exhaust system for tuning or altering a sound of a vehicle exhaust.

BACKGROUND

Internal combustion engines generate hot waste gases that are typically expelled from an exhaust port of the engine. The hot waste gases expand to release kinetic energy which in turn develops supersonic and transonic flow. As the hot waste gases expand, sonic pulses or shockwaves are produced. A broad spectrum of sounds is produced including both desired and undesired tones.

Typically sound frequencies emitted from an internal combustion engine must be filtered or altered to meet state and federal regulations. After altering a sound of the exhaust gases to meet regulations, the remainder of sounds include both unwanted sounds and sounds that may be desired, such as sounds desired by performance enthusiasts.

Various solutions have been created to alter sound produced by an internal combustion engine of a vehicle. For example, mufflers alter a sound of exhaust gases exiting an internal combustion engine by slowing down a flow of the exhaust gases and by absorbing or cancelling energy of shock waves produced by the internal combustion engine. However, mufflers are typically expensive, heavy, large in size, inefficient, and degrade over time.

Other mechanisms include various valves, both active and passive, for controlling back pressure within an exhaust system for cancelling sounds and sonic pulses. Similarly, attempts have been made to vary header tube length and utilize tunable mufflers to alter an exhaust note of a vehicle. These other attempts typically increase the complexity of a vehicle's exhaust system.

What is needed, therefore, is an exhaust system for tuning or altering a sound of a vehicle exhaust that modifies a root note of a vehicle's exhaust to produce a desirable sound.

SUMMARY

The above and other needs are met by a timbre-scaled exhaust system. In a first aspect, a timbre-scaled exhaust system includes: an inlet collector including an entrance duct at a first end of the collector in fluid communication with an exhaust flow from an internal combustion engine and an exit duct at a second end of the collector; a plurality of non-perforated parallel tuning tubes in fluid communication with the plurality of exit ducts of the inlet collector, the plurality of tuning tubes having lengths and diameters selected based on a desired note of the timbre scaled exhaust system; an outlet collector including an entrance duct in fluid communication with the at least first and second tuning tubes and an exit duct in fluid communication with an outlet of the exhaust system. The inlet collector splits the exhaust flow through the plurality of tuning tubes to create individual notes, and wherein the outlet collector combines the split exhaust flow to create a desired sound of internal combustion engine exhaust.

In one embodiment, the plurality of tuning tubes further include: at least a first tuning tube having a diameter, the diameter selected based on a first desired note and at least a second tuning tube having a second diameter that varies from the diameter of first tuning tube, the diameter of the second tuning tube selected based on a second desired note. In another embodiment, the first tuning tube has a first length and the second tuning tube has a second length that is greater than the length of the first tuning tube.

In yet another embodiment, the timbre-scaled exhaust system further includes a muffler located downstream from the inlet collector, tuning tubes, and outlet collector.

In one embodiment, the tuning tubes having a diameter such that sound waves of one of the tuning tubes substantially cancel a noise of soundwaves of another of the tuning tubes.

In another embodiment, each of the plurality of tuning tubes is visually exposed.

In yet another embodiment, the inlet collector, tuning tubes, and outlet collector are formed as a single piece by one of extrusion and casting.

In one embodiment, the tuning tubes have a diameter of between 1" and 1.5". In another embodiment, the tuning tubes have a length of from about 1" to about 8". In another embodiment, the tuning tubes comprise between 3 and 5 parallel tuning tubes.

In yet another embodiment, the timbre-scaled exhaust system further includes a plurality of lobes formed around the exit duct of the inlet collector and the entrance duct of the outlet collector, the plurality of lobes shaped to receive the tuning tubes. In one embodiment, the lobes are adapted to receive a first number of tuning tubes in a first configuration and further adapted to receive a second number of tuning tubes in a second configuration.

In a second aspect, a timbre-scaled internal combustion exhaust system includes: an inlet collector including a single entrance duct at a first end of the collector in fluid communication with an exhaust flow from an internal combustion engine and an exit duct at a second end of the collector; a plurality of non-perforated parallel tuning tubes in fluid communication with the plurality of exit ducts of the inlet collector including at least a first tuning tube having a diameter, the diameter selected based on a first desired note and at least a second tuning tube having a second diameter that varies from the diameter of first tuning tube, the diameter of the second tuning tube selected based on a second desired note; an outlet collector including a plurality of entrance ducts in fluid communication with the at least first and second tuning tubes and a single exit duct in fluid communication with an outlet of the exhaust system. The inlet collector splits the exhaust flow through the plurality of tuning tubes to create individual notes, and wherein the outlet collector combines the split exhaust flow to create a desired sound of internal combustion engine exhaust.

In a third aspect, a timbre-scaled internal combustion exhaust system includes: an inlet collector including a single entrance duct at a first end of the collector in fluid communication with an exhaust flow from an internal combustion engine and an exit duct at a second end of the collector; a plurality of non-perforated parallel tuning tubes in fluid communication with the plurality of exit ducts of the inlet collector including at least a first tuning tube having a diameter, the diameter selected based on a first desired note and at least a second tuning tube having a second diameter that varies from the diameter of first tuning tube, the diameter of the second tuning tube selected based on a second desired note; an outlet collector including a plurality of entrance ducts in fluid communication with the at least first and second tuning tubes and a single exit duct in fluid communication with an outlet of the exhaust system. The inlet collector splits the exhaust flow through the plurality of tuning tubes to create individual notes, and wherein the outlet collector combines the split exhaust flow to create a desired sound of internal combustion engine exhaust.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

A timbre scaled exhaust system 10 is provided for tuning an exhaust flow from an internal combustion engine and producing an exhaust note that has a desirable sound or timbre. The timbre scaled exhaust system 10 of the present disclosure includes a plurality of tuning tubes in communication with an exhaust system on a vehicle to attenuate any unwanted exhaust sounds and produce an overall desirable timbre without requiring the use of a traditional muffler structure.

Referring to FIGS. 1-5, the timbre scaled exhaust system 10 includes a tubular exhaust pipe 12. The exhaust pipe 12 is in fluid communication with one or more exhaust ports of an internal combustion engine such that hot gases expelled from the internal combustion engine flow from the internal combustion engine into the exhaust pipe 12. The expelled exhaust gas may pass through one or more other exhaust system components before entering the exhaust pipe 12, such as exhaust headers and a Y-pipe to combine exhaust from the internal combustion engine into a single exhaust pipe. The exhaust pipe 12 may include a number of bends along a length of the exhaust pipe 12. The exhaust pipe 12 terminates at an exhaust tip 13, at which point expelled exhaust gas from the internal combustion engine is discharged from the exhaust system 10.

Figure 1:
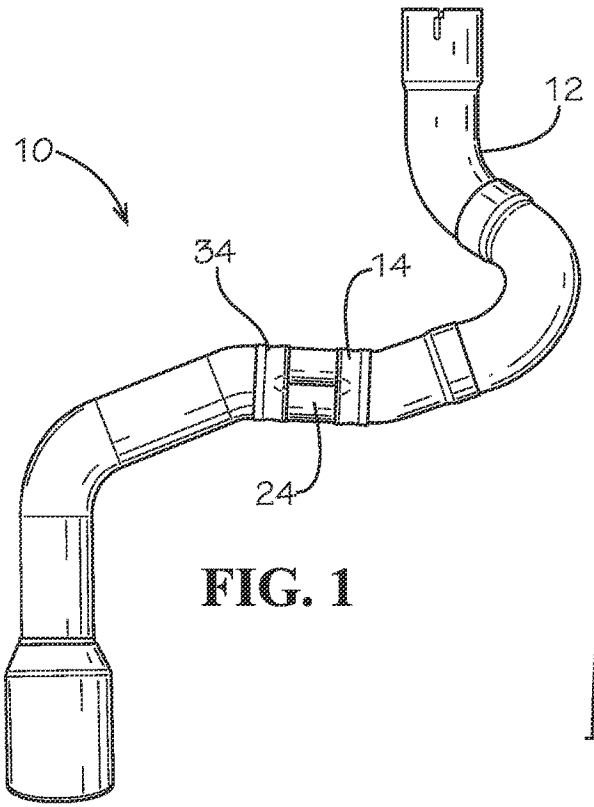
FIG. 1 shows a top view of a timbre scaled exhaust system according to one embodiment of the present disclosure.
Figure 2:
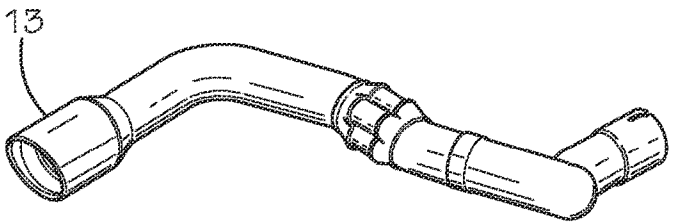
FIG. 2 shows a perspective view of a timbre scaled exhaust system according to one embodiment of the present disclosure.
Figure 3:
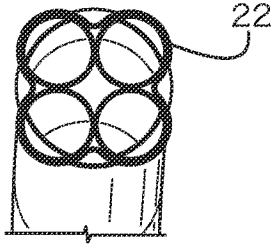
FIG. 3 shows a cross sectional view of a plurality of tuning tubes according to one embodiment of the present disclosure.
Figure 4:
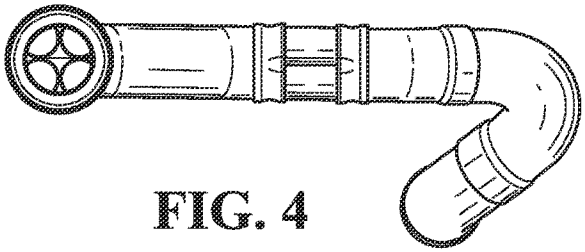
FIGS. 4 and 5 show side views of a timbre scaled exhaust system according to one embodiment of the present disclosure.
Figure 5:
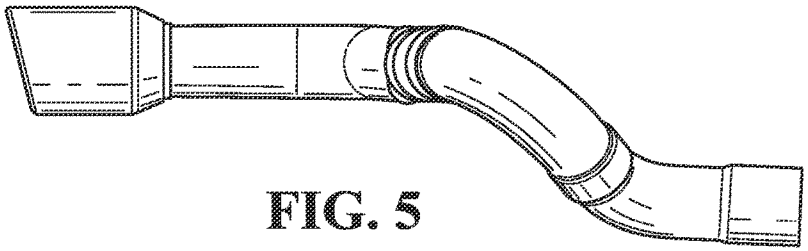
Figure 6:
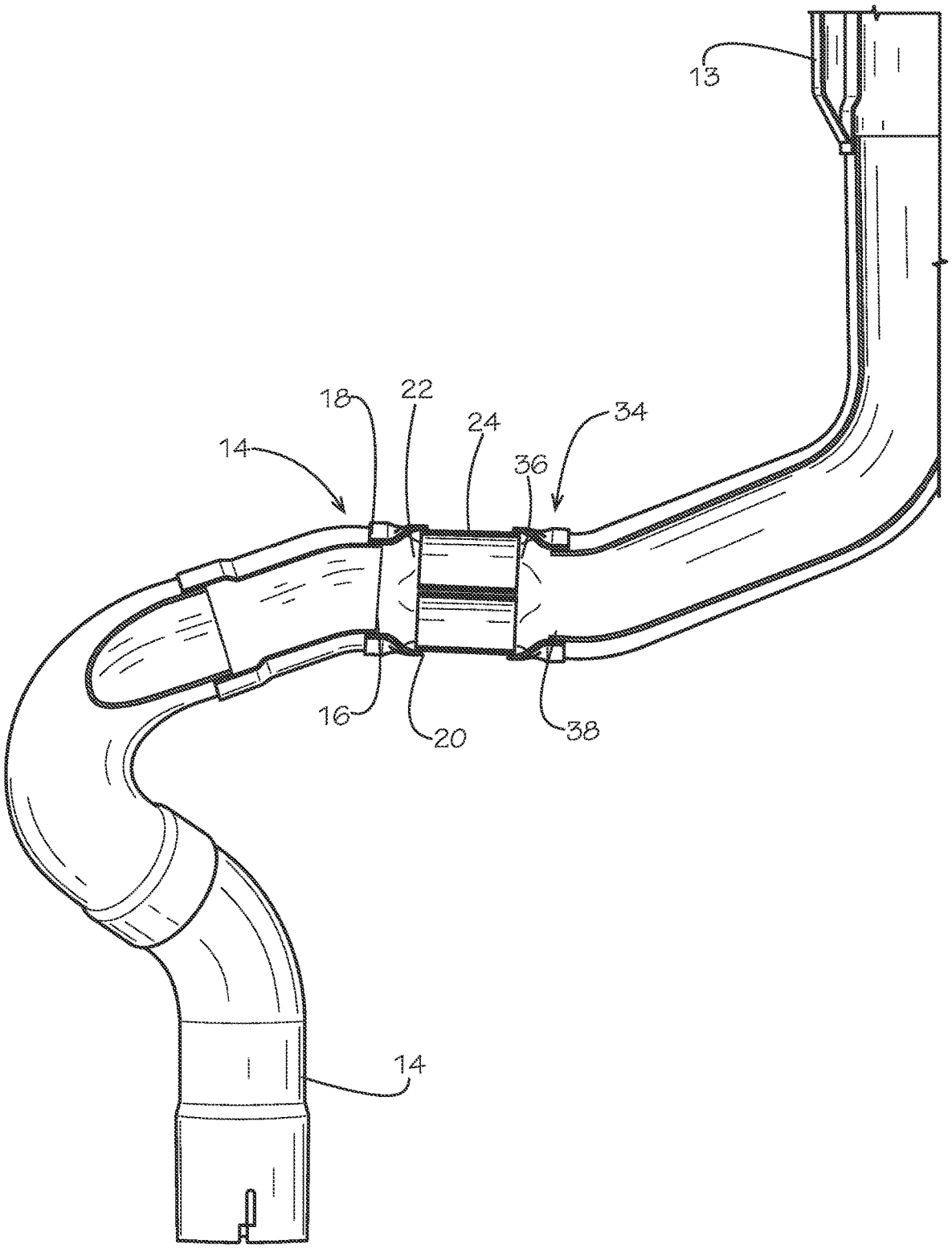
FIG. 6 shows a cross-sectional side view of a timbre scaled exhaust system according to one embodiment of the present disclosure.
Figure 8:
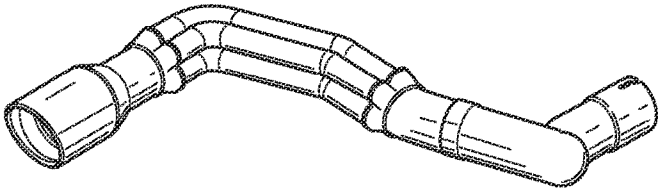
FIG. 8 shows a perspective view of a timbre scaled exhaust system according to one embodiment of the present disclosure.

An inlet collector 14 is located in fluid communication with the exhaust pipe 12. The inlet collector 14 has a single entrance duct 16 (FIG. 6) adjacent to and in fluid communication with the exhaust pipe 12 at a first end 18 of the inlet collector 14. The inlet collector 14 extends to a second end 20. The second end 20 of the inlet collector includes an exit duct 22 formed on the inlet collector 14. In one embodiment, the exit duct 22 is split into a plurality of exit ducts 22 aligned with tuning tubes as described below. Diameters of each of the plurality of exit ducts 22 may vary as discussed in greater detail below. The inlet collector 14 is shaped such that as expelled exhaust gas from the internal combustion engine enters the inlet collector 14 through the entrance duct 16, the gas is split and directed into the plurality of exit ducts 22.

Referring again to FIGS. 1-5, the timbre scaled exhaust system 10 includes a plurality of tuning tubes 24 in fluid communication with the exit ducts 22 of the inlet collector 14. The tuning tubes 24 are preferably non-perforated and are hollow having a smooth interior surface. The tuning tubes 24 are in communication with the exhaust pipe 12 and each of the tuning tubes 24 is configured to tune a sound of the exhaust system by forming each of the tuning tubes 24 into a desired diameter, length and shape. The tuning tubes 24 define a plurality of elongate tuning chambers oriented parallel to a flow of exhaust through the timbre scaled exhaust system 10. The tuning chambers defined within the tuning tubes 24 receive sound waves propagating along a length of the timbre scaled exhaust system and attenuate unwanted sound waves to produce a desired note of the sound wave as it exits each of the tuning tubes or such that an overall exhaust note is enhanced based on sound waves combining after exiting the plurality of tuning tubes 24. The tuning tubes 24 are oriented parallel to one another and are preferably adjacent such that the tuning tubes 24 contact one another along their lengths.

As shown in FIGS. 1-5, in one embodiment each of the tuning tubes 24 may have a substantially equivalent diameter and length, the diameter and length determined based on a sound desired to be produced by the timbre scaled exhaust system 10. FIGS. 7-11 illustrate another embodiment of the timbre scaled exhaust system 10 wherein the plurality of tuning tubes 24 have varying lengths. Further, a diameter of bends in the tuning tubes 24 may vary to further produce a desired note. For example, the timbre scaled exhaust system 10 of FIGS. 7-11 includes outer tuning tubes 26 and inner tuning tubes 28. The outer tuning tubes 26 have a length that is greater than the inner tuning tubes 28, and further have bend diameters that are greater than the inner tuning tubes 28.

Referring now to FIGS. 12-16, in one embodiment each of the tuning tubes 24 has a diameter corresponding to a particular desired note. A desired note of the tuning tubes 24 may be determined based on known methods of attenuating sound waves along a length of tubing. The tuning tubes 24 may each have a particular diameter that is different from other tuning tubes 24 of the timbre scaled exhaust 10. The tuning tubes 24 having varying diameters may also include varying lengths and bend diameters depending on an orientation of each tuning tube 24 of the timbre scale exhaust system 10. As illustrated in the figures, the tuning tubes 24 may extend from the inlet collector 14 to the outlet collector 34 in a substantially straight line without any bends. Alternatively, the tuning tubes 24 may include one or more bends along lengths of the tuning tubes 24 between the inlet collector 14 and the outlet collector 34.

While the above description and accompanying figures show the tuning tubes 24 being substantially cylindrical in shape, it is also understood that the tuning tubes may be formed in various other suitable shapes. For example, the tuning tubes 24 may have rectangular cross-sectional areas, or may be formed into a variety of other shapes.

Referring again to FIG. 1, the tuning tubes 24 extend from a first end 30 adjacent the inlet collector 14 to a second end 32 adjacent an outlet collector 34. The outlet collector 34 includes a plurality of entrance ducts 36 (FIG. 6) in fluid communication with each of the tuning tubes 24 for receiving a flow of exhaust gas from the tuning tubes 24. The outlet collector 34 further includes an exit duct 38 in fluid communication with the entrance ducts 36 such that a flow from the tuning tubes 24 is combined into a single flow exiting the outlet collector 34. The exit duct 38 of the outlet collector 34 is attached to the exhaust pipe 14 such that the combined exhaust and sound waves from the tuning tubes 24 is emitted from the exhaust tip 13 of the exhaust system.

Figure 17:
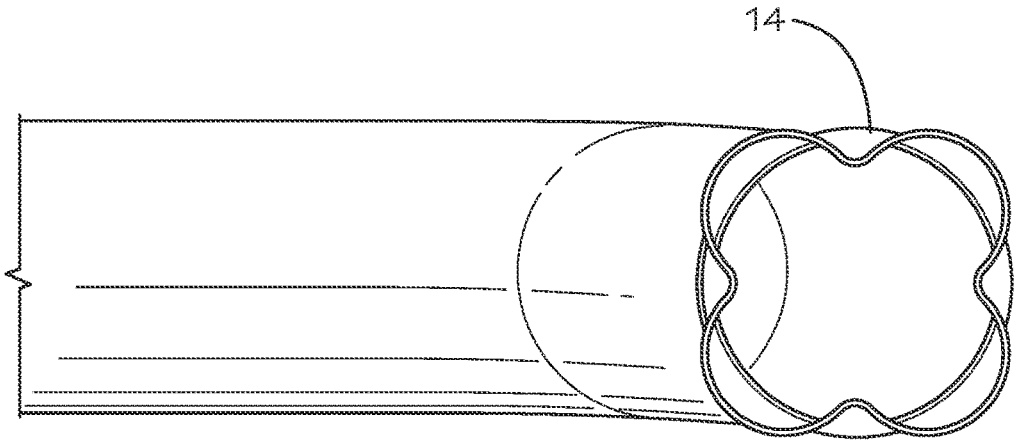
FIG. 17 shows a cross-sectional view of an inlet collector according to one embodiment of the present disclosure.
Figure 18:
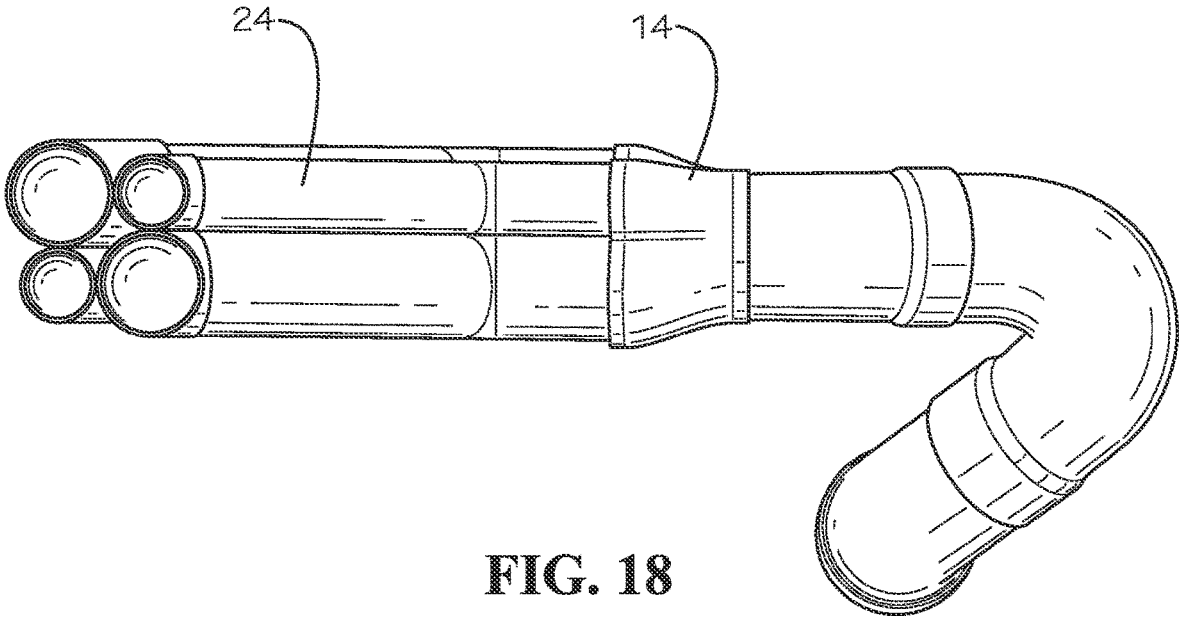
FIG. 18 shows a cross-sectional view of a plurality of tuning tubes having varying diameters according to one embodiment of the present disclosure.

While the inlet collector 14 and outlet collector 34 are described as having a plurality of exit ducts 22 on the inlet collector 14 and entrance ducts 36 on the outlet collector 34, it is also understood that the collectors 14 and 34 may have other various shapes for diverting an exhaust flow from a single exhaust pipe to the plurality of tuning tubes 24. For example, as shown in FIG. 17, the inlet collector 14 and outlet collector 34 may include an end that is shaped to conform to the plurality of tuning tubes 24 without including separate ducts within the collectors 14 and 34. The collectors 14 and 34 may be formed into other various shapes that allow an exhaust flow of the vehicle to separate into the plurality of tuning tubes 24 and rejoin after passing through the tuning tubes 24 before being discharged through the exhaust tip 13.

The inlet collector 14, tuning tubes 24, and outlet connector 34 are preferably exposed and do not include a shell or other structure that encloses the timbre scaled exhaust system 10. The inlet collector 14, tuning tubes 24, and outlet collector 34 together define an acoustic portion of the timbre scaled exhaust system 10. In one embodiment, the inlet collector 14, tuning tubes 24, and outlet collector 34 are mechanically joined, such as by welding. In another embodiment, the inlet collector 14, tuning tubes 24, and outlet collector 34 are formed as a single piece, such as by casting of the acoustic portion of the timbre scaled exhaust system 10. In yet another embodiment, portions of the timbre scaled exhaust system 10 including the tuning tubes 24 are formed by extrusion, such as metal extrusion.

Dimensions and shapes of the tuning tubes may be selected based on a relationship between a root note of a vehicle and a desired note to be produced by each of the tuning tubes 24 and an overall desired note of the vehicle. For example, if an internal combustion engine of a particular vehicle is known to produce a root note that includes some undesirable characteristics, the timber scaled exhaust system 10 would include tuning tubes 24 that are sized and shaped to alter the root note of the internal combustion engine to produce an overall desired note. Such relationship may be derived using a mathematical formula to determine an appropriate diameter and length of the tuning tubes in relation to a desired note. Existing methods of attenuating sound waves along a body may be used to calculate appropriate dimensions of the tuning tubes 24 such as a desired length and diameter of the tuning tubes 24.

While FIGS. 1-18 show a timbre scaled exhaust system 10 featuring four tuning tubes 24, it is understood that various configurations of parallel tuning tubes 24 may be selected based on desired attenuation of sound waves. For example, in one embodiment three tuning tubes 24 may be formed between the inlet collector 14 and outlet collector 34. In another embodiment, five tuning tubes 24 may be located between the inlet collector 14 and outlet collector 34.

Figure 9:
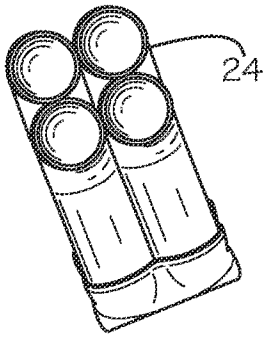
FIG. 9 shows a cross sectional view of a plurality of tuning tubes according to one embodiment of the present disclosure.
Figure 7:
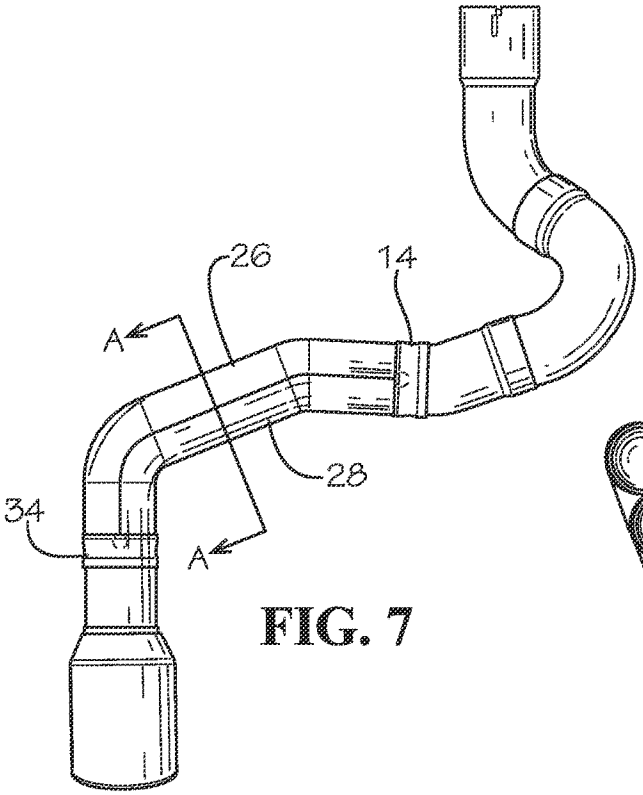
FIG. 7 shows a top view of a timbre scaled exhaust system according to one embodiment of the present disclosure.
Figure 11:
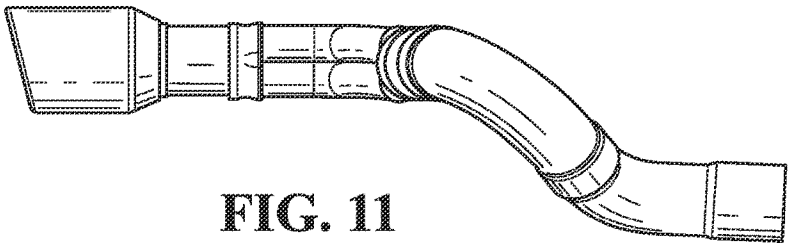
FIGS. 10 and 11 show side views of a timbre scaled exhaust system according to one embodiment of the present disclosure.
Figure 10:
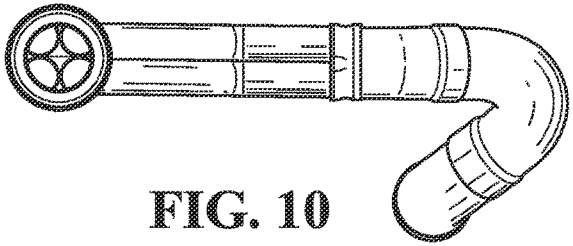
Figure 13:
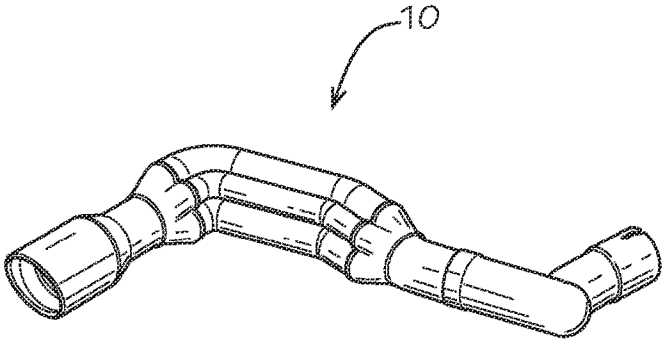
FIG. 13 shows a perspective view of a timbre scaled exhaust system according to one embodiment of the present disclosure.
Figure 16:
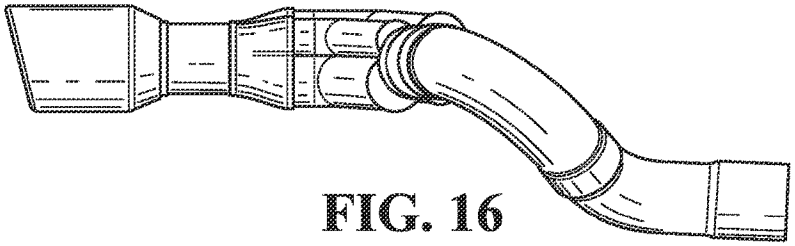
FIGS. 15 and 16 show side views of a timbre scaled exhaust system according to one embodiment of the present disclosure.
Figure 14:
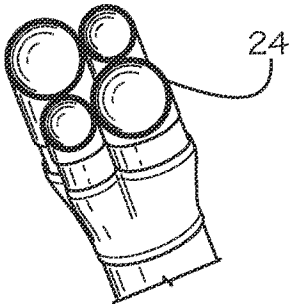
FIG. 14 shows a cross-sectional view of a plurality of tuning tubes according to one embodiment of the present disclosure.
Figure 12:
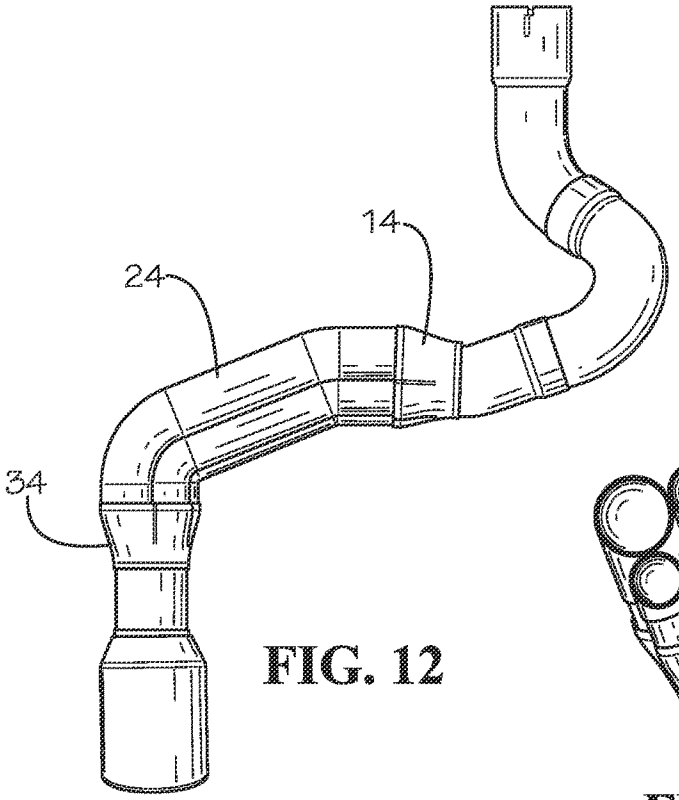
FIG. 12 shows a top view of a timbre scaled exhaust system according to one embodiment of the present disclosure.
Figure 15:
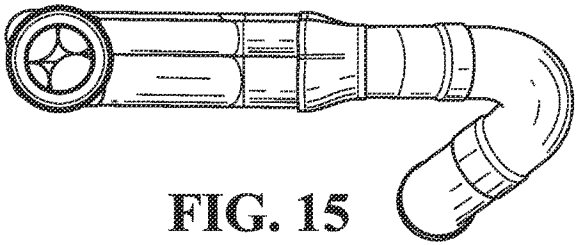
Figure 19:
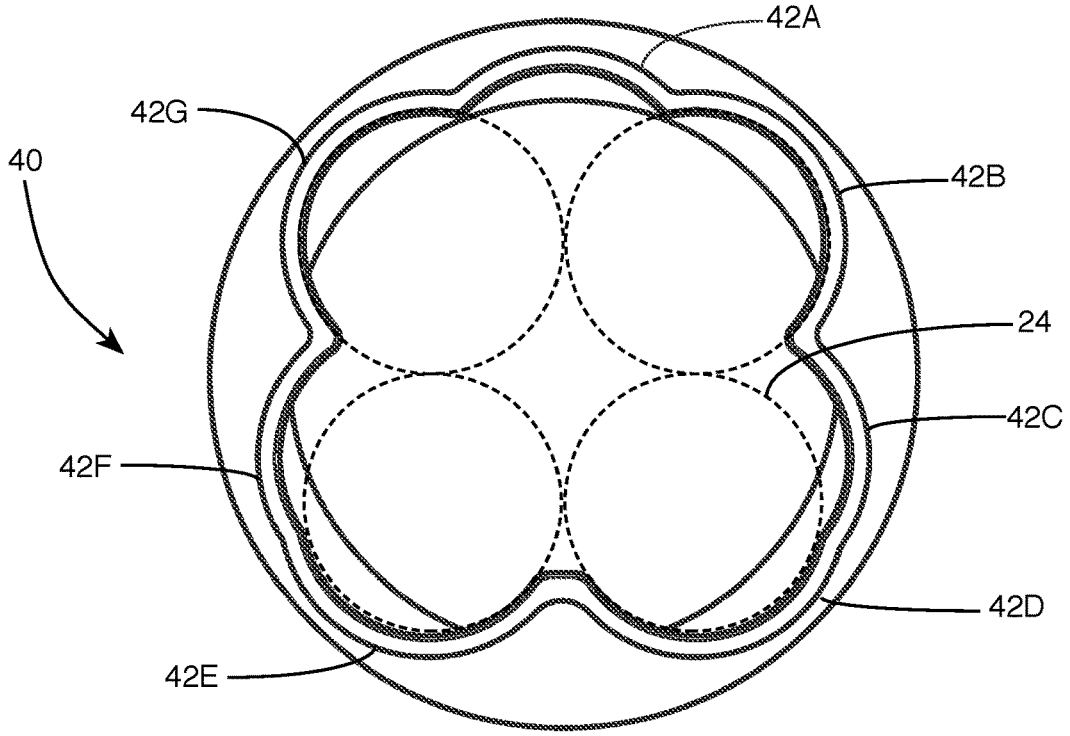
FIGS. 19 and 20 show a cross-sectional lengthwise view of a collector according to one embodiment of the present disclosure.
Figure 20:
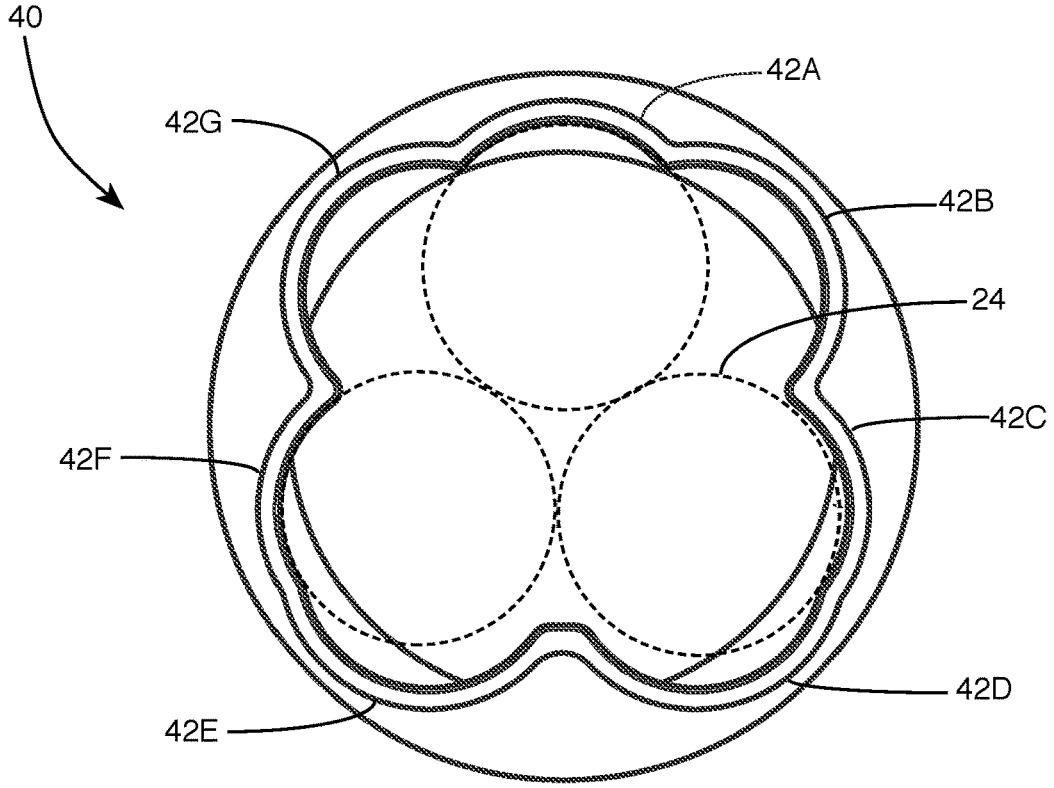

Referring to FIGS. 19 and 20, in one embodiment a collector 40 includes a plurality of lobes 42A-42G formed around the collector 40. The plurality of lobes 42A-42G are shaped to receive tuning tubes 24 in various sizes and configurations depending on a desired note of an exhaust system. For example, as shown in FIG. 9, the tuning tubes 24 are sized and positioned within lobes of the collector 40 such that the tuning tubes are arranged in a quadruple tube configuration. As shown in FIG. 20, the same collector 40 may also accept tuning tubes 24 in a triple tube configuration, with each tube having a diameter that is greater than a diameter of tuning tubes 24 in the quadruple tube configuration. The lobes 42A-42G preferably have varying diameters such that certain of the lobes may accept tuning tubes 24 in a first configuration, while other of the lobes may accept tuning tubes in a second configuration. The lobes 42A-42G are preferably formed on the exit duct 16 of the inlet collector 14 and the entrance duct 36 of the outlet collector 34. Tuning tubes 24 are preferably secured between lobes 42A-42G of the inlet collector 14 and outlet collector 34.

The timbre scaled exhaust system 10 of the present disclosure may further be used in addition to other attenuating devices, such as a muffler. For example, in one embodiment one or more of the acoustic portions may be located upstream from a muffler such that sound waves are enhanced prior to entering the muffler. Further, multiple acoustic portions may be installed parallel to one another, such as in a dual exhaust system whereby sound waves passing through a first acoustic portion exit a first exhaust pipe, while sound waves passing through a second acoustic portion exit a second exhaust pipe.

The timbre scaled exhaust system 10 is preferably formed from steel, such as a corrosion resistant mild carbon steel or other like material known to be suitable for vehicle exhaust components. Each of the inlet collector 14, tuning tubes 24, and outlet collector 34 may be joined by welding or by mechanical fastening. While the figures and above description contemplate the various components of the timbre scaled exhaust system 10 being substantially tubular in shape, it is also understood that the components may be formed into various other shapes, such as squares, hexagons, ovals, or other various geometric shapes.

The timbre scaled exhaust system 10 is preferably installed on a vehicle in-line with the vehicle's exhaust pipe and downstream from an internal combustion engine and exhaust headers of the vehicle. The timbre scaled exhaust system 10 may be installed as part of the vehicle's existing exhaust pipe or, alternatively, may be installed as part of a new exhaust system including a new exhaust pipe of the vehicle.

In operation, exhaust gases and any sonic pulses or shockwaves emitted from an internal combustion engine into and along a length of the exhaust pipe 14. A first sound is created by the exhaust gases and resulting sonic pulses in the exhaust pipe 14. As the sound waves reach the inlet collector 14, the soundwave passes into each of the plurality of tuning tubes 24. Depending on a diameter, length, and shape of each of the tuning tubes 24, a timbre and level of the exhaust is adjusted to desired levels. The exhaust is re-combined in the outlet collector 34 and then discharged through the exhaust tip 13.

It has been found that dispersing and breaking up frequencies and harmonics of an exhaust system into smaller compressed areas creates pitch harmony and a desirable note of an exhaust system. Incoming sound waves are diverted to individual tuning tubes and enhanced based on dimensions of the tuning tubes. An overall note or tone of exhaust of a vehicle is further enhanced when the sound waves rejoin in the outlet collector 34.

The timbre scaled exhaust system of the present disclosure advantageously enhances a sound emitted by an internal combustion engine to have an overall note that is desirable to a user. The timbre scaled exhaust system may be pre-configured and shipped with various combinations of tuning tube dimensions that enable the timbre scaled exhaust system to be readily installed on a vehicle. The timbre scaled exhaust system may be pre-configured for a particular type of vehicle. Further, multiple variations of the timbre scaled exhaust system may be provided to allow a user to select a desired note of the user's vehicle.

The timbre scaled exhaust system advantageously provides a system for altering and producing a desired note from a root note of an internal combustion engine of a vehicle. The timber scaled exhaust system may create multiple frequencies from a single exhaust root note wherein the multiple frequencies combine to create an overall sound that is pleasing to a user and reduces or eliminates unwanted notes of a vehicle's internal combustion engine. The timbre scaled exhaust system may not only modify a note of a vehicle's internal combustion engine but may also create an overall sound that is reduced such that a sound level of the vehicle is in compliance with state and federal regulations.

The timbre scaled exhaust system substantially reduces a weight of a vehicle's exhaust system and will minimize an amount of space required for installation in comparison to a muffler or resonator. Because the tuning tubes of the timber scaled exhaust system do not require a housing or other structure to surround the timbre scaled exhaust system, the exposed tuning tubes and collectors create an appearance of performance on a vehicle that is desired by users. Finally, because the timbre scaled exhaust system does not include components that absorb or otherwise are consumed by exhaust gases, the timbre scaled exhaust system is substantially durable and will not rapidly degrade over time.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A timbre-scaled exhaust system, the system comprising:

a collector including an entrance duct at a first end of the collector for receiving an exhaust flow from an internal combustion engine and an exit duct at a second end of the collector, wherein a first arrangement of lobes is formed around one of the exit duct or the entrance duct of the collector, wherein the first arrangement of lobes are adapted to receive a first number of tuning tubes in a first configuration, wherein a second arrangement of lobes is formed around the one of the exit duct or the entrance duct of the collector, wherein the second arrangement of lobes are adapted to receive a second number of tuning tubes in a second configuration, and wherein in the first configuration the second arrangement of lobes is unused by the tuning tubes and in the second configuration the first arrangement of lobes is unused by the tuning tubes.

2. The system of claim 1, further comprising a plurality of tuning tubes fluidically coupled to the one of the exit duct or the entrance duct of the collector.

3. The system of claim 2, wherein the plurality of tuning tubes each have a diameter selected based on a desired note of the internal combustion engine, wherein each of the plurality of tuning tubes is arranged in parallel to one another along lengths of the tuning tubes.

4. The system of claim 2, wherein a first tuning tube of the plurality of tuning tubes has a first length and a second tuning tube of the plurality of tuning tubes has a second length that is greater than the first length.

5. The system of claim 2, each of the plurality of tuning tubes further comprising a bend along a length of the plurality of tuning tubes between first ends and second ends of the tuning tubes.

6. The system of claim 2, wherein each of the plurality of tuning tubes is visually exposed.

7. The system of claim 1, wherein the collector is an inlet collector, and the first arrangement of lobes and the second arrangement of lobes are formed around the exit duct of the collector.

8. The system of claim 7, further comprising an exhaust pipe in fluid communication with the entrance duct of the collector.

9. The system of claim 7, further comprising an outlet collector, the first arrangement of lobes of the outlet collector and the second arrangement of lobes of the outlet collector are formed around the entrance duct of the outlet collector.

10. The system of claim 9, further comprising a plurality of tuning tubes each having first ends and second ends, wherein the first ends of the plurality of tuning tubes are fluidically coupled to the exit duct of the inlet collector, wherein the second ends of the plurality of tuning tubes are fluidically coupled to the entrance duct of the outlet collector.

11. The system of claim 10, wherein the inlet collector, the plurality of tuning tubes, and the outlet collector are formed as a single piece by extrusion or casting.

12. The system of claim 10, wherein the plurality of tuning tubes comprises between 3 and 5 parallel tuning tubes.

13. The system of claim 10, wherein the orientation of the first ends of the plurality of tuning tubes is different than the orientation of the second ends of the plurality of tuning tubes.

14. The system of claim 1, wherein the collector is an outlet collector, and the first arrangement of lobes and the second arrangement of lobes are formed around the entrance duct of the collector.

15. The system of claim 14, further comprising an exhaust outlet in fluid communication with the exit duct of the collector.

16. The system of claim 14, wherein the tuning tubes further comprises:

at least a first tuning tube having a first diameter, the first diameter being selected based on a first desired note; and at least a second tuning tube having a second diameter, the second diameter being selected based on a second desired note, wherein the first diameter is different from the second diameter, wherein the first desired note and the second desired note are combined at the collector to create a desired combined note of the internal combustion engine.

17. The system of claim 1, wherein the collector splits the exhaust flow through the tuning tubes, wherein the flow of exhaust through each of the tuning tubes creates individual notes based on a diameter of each of the tuning tubes.

18. The system of claim 1, wherein the collector combines a split exhaust flow to create a desired combined note of the exhaust flow from the internal combustion engine emitted from the exhaust outlet, the combined note created from individual notes based on a diameter of each of the tuning tubes.

19. The system of claim 1, further comprising a muffler located downstream from the collector.

20. The system of claim 1, where each of the tuning tubes has a diameter that is different than a diameter of other of the tuning tubes.

* * * * *